US005894803A

United States Patent [19]

Kuga

[11] Patent Number: 5,894,803

[45] Date of Patent: Apr. 20, 1999

[54] PALLET FOR CARRYING AN AUTOMOTIVE SEAT

[75] Inventor: Kenichi Kuga, Tochigi-ken, Japan

[73] Assignee: Tokyo Seat Co., Ltd., Japan

[21] Appl. No.: 08/910,262

[22] Filed: Aug. 13, 1997

[30] Foreign Application Priority Data

Aug. 13, 1996 [JP] Japan ..... 8-231501
Aug. 13, 1997 [JP] Japan ..... 9-252582

[51] Int. Cl.[6] ..... B65D 19/00

[52] U.S. Cl. ..... 108/51.11; 108/57.25

[58] Field of Search ..... 100/51.11, 901, 100/902, 55.3, 57.25

[56] References Cited

U.S. PATENT DOCUMENTS

| | | | |
|---|---|---|---|
| 3,910,203 | 10/1975 | Hamkins et al. | 108/51.11 |
| 5,101,964 | 4/1992 | Westphal | 108/901 X |
| 5,373,961 | 12/1994 | Harris et al. . | |
| 5,497,708 | 3/1996 | Jeruzal | 108/55.3 X |
| 5,520,121 | 5/1996 | Schubart et al. | 108/55.3 X |
| 5,529,185 | 6/1996 | Alspach et al. | 108/55.3 X |

FOREIGN PATENT DOCUMENTS 92471 1/1997 Japan .

*Primary Examiner*—Jose V. Chen
*Attorney, Agent, or Firm*—Dann, Dorfman, Herrell and Skillman, P.C.

[57] ABSTRACT

A pallet for carrying a driver's seat and an assistant driver's seat, or a seat for several passengers, comprising a substantially rectangle-shaped base plate, a frame-like rising section of a substantially rectangle-shape rising from a surface of the base plate, on which the driver's seat and assistant driver's seat or the seat for several passengers are to be carried, and surrounding said base plate, the base plate and frame-like rising section formed as one piece, by reaction injection molding, of resinous material containing as the main component thereof dicyclopentadiene which is $C_5$ fraction of petroleum, and a pair of square sections assembled to long side portions of the substantially rectangle-shaped rising section, whereby the pallet has physical properties such as general strength, resistance to the total weight of the driver's seat and assistant driver's seat or the seat for several passengers, resistance to deflection, resistance to wear, refractory strength, low temperature strength, and solvent resistance, and can conform to the requirements for a thin-type pallet.

8 Claims, 6 Drawing Sheets

PALLET FOR CARRYING AN AUTOMOTIVE SEAT

BACKGROUND OF THE INVENTION

1. Field of the Invention

This invention relates to an improvement of a palette for carrying seats in a pair or a seat for several persons, and more particularly to a palette for carrying a driver's seat for an automobile and an assistant driver's seat for the automobile in a pair, or an automotive seat for several passengers.

2. Description of the Prior Art

In general, when automotive seats which are made in an assembly line are to be shipped, they are carried on palettes and conveyed by hangers of a conveyance line to a place where the seats are carried out. As examples of such palettes, there are conventionally employed wooden palettes which are assembled using veneers or square timbers.

Chips of wood are easy to generate from the wooden palettes and are scattered about in the assembly line. As a result, the chips stick to the seats on the palette. Labor in which the chips are removed from the seats with effort is required. Further, the wooden palletes are easy to break due to fraying and crack in the palettes. Therefore, the wooden palettes frequently require repair.

If a resinous palette is employed in lieu of the wooden palette, there is no inconvenience which the chips are produced from the wooden palette. However, from the special standpoint of what the resinous palette carries the seats thereon, it becomes necessary for the resinous palette to conform to the following requirements.

For example, when a driver's seat for an automobile and an assistant driver's seat in a pair are carried on the resinous palette, the total weight of the driver's seat and assistant driver's seat is about 120 kg. Therefore, the resinous palette should have strength properties such as stress cracking resistance, resistance to deflection, and resistance to wear.

From the standpoint of what the palette carries seats in a pair or a seat for several persons, the palette is required to have a carrying area of about 1330 mm in length and about 700 mm in width. Also, the palette is required to be lightweight and required to have a weight of about 18 kg or less, because the palette is set on an equipment for shipment when the seats are consigned. The palette is desired to be thin, because there is height limitation of the equipment for shipment. In addition to this, the palette should be resistant to −10° C.–80° C. temperature environments, since the palette is stored in a warehouse or is kept in the open air.

Further, a lubricant such as grease is applied to a slide rail of an automotive seat, so that the lubricant will drip onto the palette. Therefore, the palette should have solvent resistance. In addition, the palette is required not to be susceptible to the contamination of the lubricant, and is required to allow the lubricant to be easily removed therefrom.

SUMMARY OF THE INVENTION

It is therefore an object of this invention to provide a palette for carrying seats or a seat, which conforms to the requirements according to distinctiveness in which the palette carries a seat or a pair of seats thereon.

BRIEF DESCRIPTION OF THE DRAWINGS

These and other objects and many of the attendant advantages of the present invention will be readily appreciated as the same becomes better understood by reference to the following detailed description when considered in connection with the accompanying drawings, in which like reference numerals designate like or corresponding parts throughout; wherein.

DETAILED DESCRIPTION OF THE PREFERRED EMBODIMENTS

Referring to FIGS. 1–6, there is illustrated a preferred embodiment of a palette for carrying a driver's seat and an assistant driver's seat (not shown) in a pair according to the present invention. The palette comprises a body 1 of resinous material, and reinforcing means assembled to the palette body 1 for giving rigidity to the palette body 1. The reinforcing means comprises square sections, e.g., square steel pipes *2a*, *2b*.

The palette body 1 is formed, by reaction injection molding, of resinous material which contains as the main component thereof dicyclopentadiene which is $C_5$ fraction of petroleum and physically contributes to the toughness, low-temperature impact strength, heat-resistance and solvent resistance of the resinous material. In order to provide a lightweight and thin palette body, the palette body 1 is thinned as a whole.

When the palette body 1 is formed by reaction injection molding, dicyclopentadiene is used as the main component of the resinous material, and catalyst for polymerization and activator are employed as reaction stock solutions and the essential components of the resinous material. Further, reinforcers such as glass fibers and carbon fibers, antioxidants, pigments, and fire retardancy may be used. Incidentally, the preferred composition of the resinous material and known preparation techniques therefor are disclosed in Japanese Laid-Open Publication No. Hei 7-137069.

The palette body 1 which is formed of dicyclopentadiene resin material is superior in formability to a palette body which is formed using reaction stock solutions such as urethane, urea, nylon, epoxy, unsaturated polyester or phenol. Further, even though the total weight of the palette according to the present invention is set to 80 kg or less, it can withstand a load of 120 kg or more. In addition, the palette of the present invention has strength which can withstand −10° C.–80° C. temperature circumstances. Also, according to the present invention, it is possible to provide the palette which has solvent resistance to a lubricant such as grease, is not susceptible to the contamination of a lubricant, and in which it is possible to easily swab the contamination of a lubricant.

Figure 1:
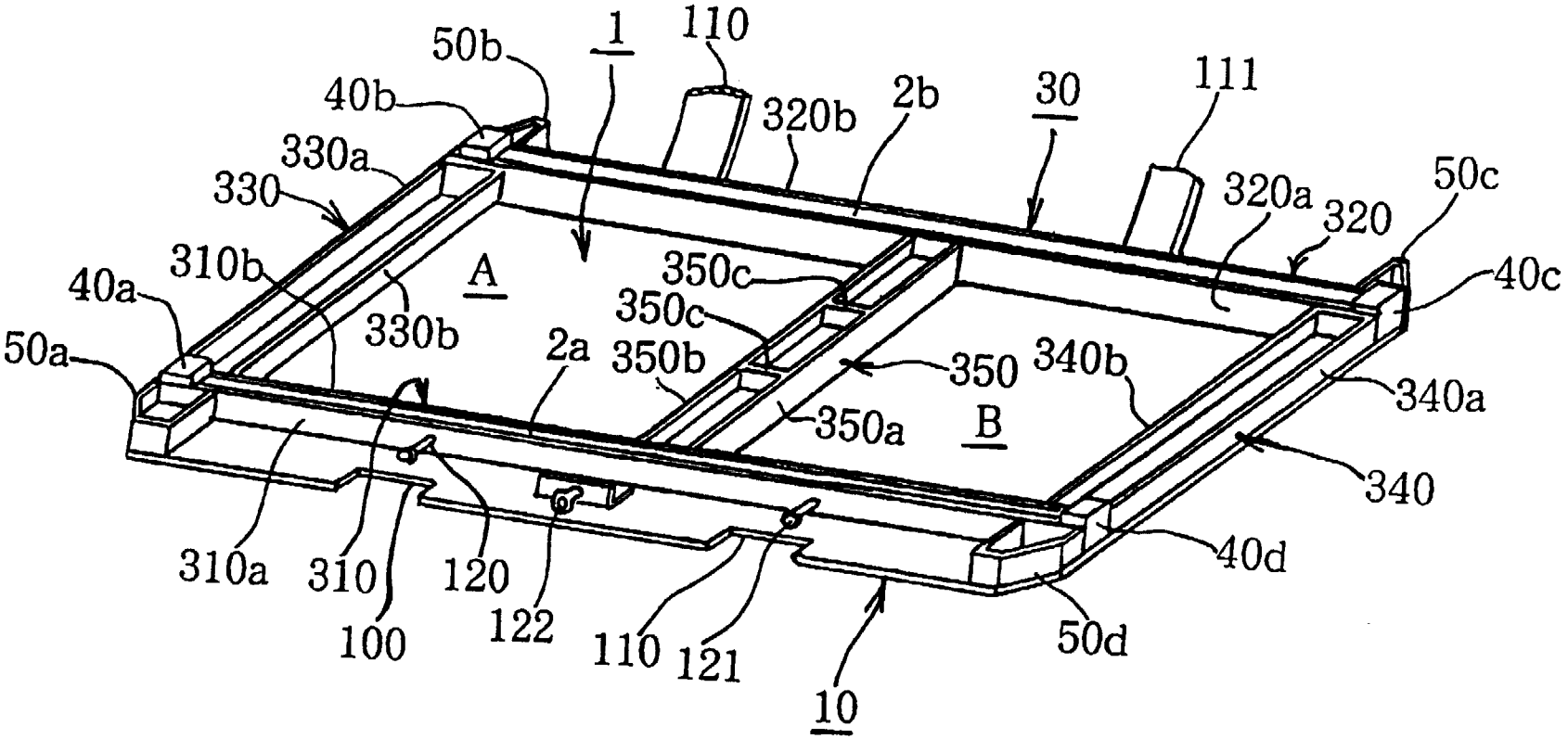
FIG. 1 is a schematic perspective view of an embodiment of a resinous palette for carrying seats or a seat according to the present invention.
Figure 2:
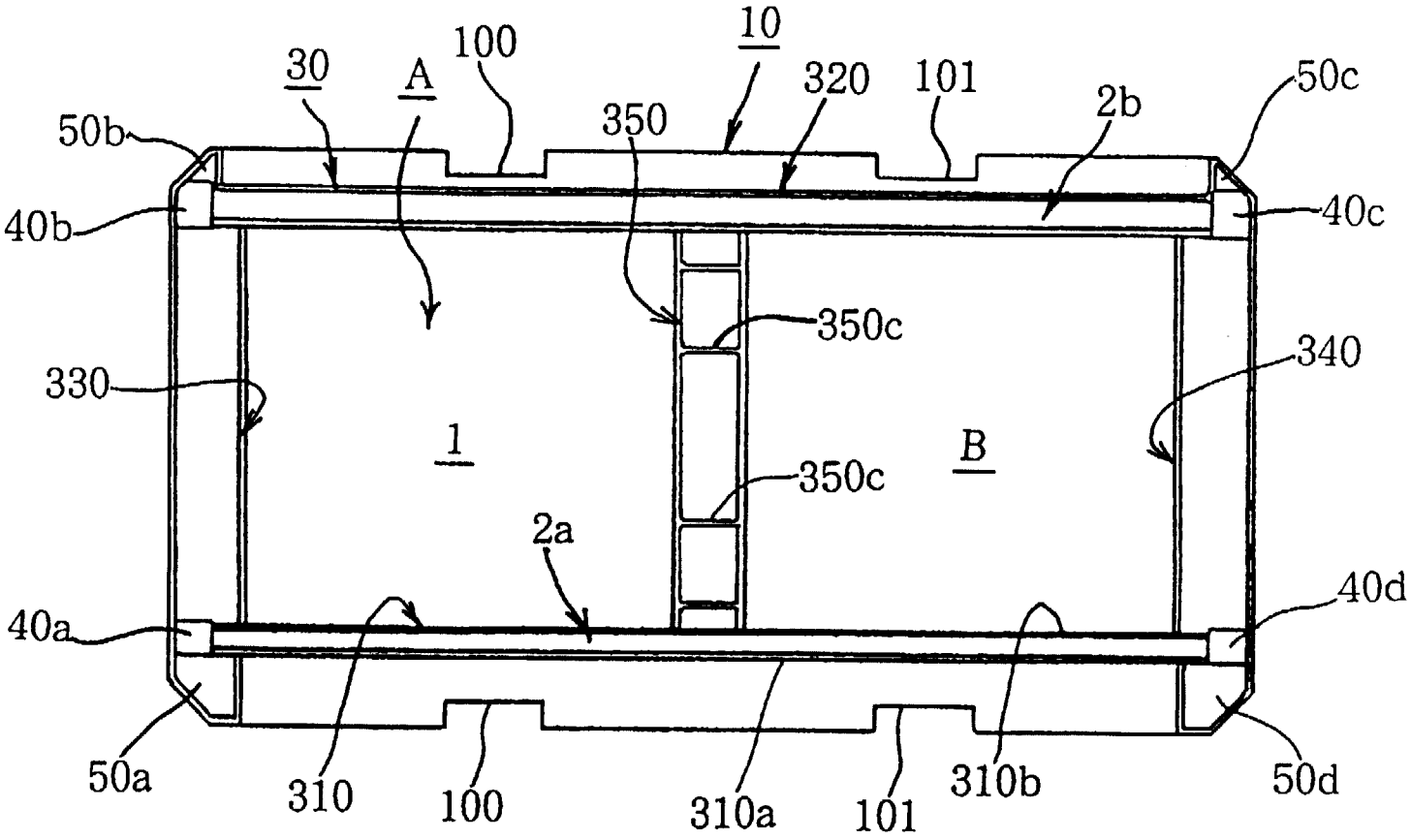
FIG. 2 is a schematic plan view showing the palette.

As shown in FIGS. 1 and 2, the palette body 1 comprises a substantially rectangle-shaped base plate 10 and a frame section 30 of a substantially rectangular shape which rises from a surface of the base plate 10 and surrounds the rectangle-shaped base plate 10. The driver's seat and assistant driver's seat are adapted to be carried on the surface of the base plate 10. The base plate 10 has an area which allows the driver's seat and assistant driver's seat in a pair to be carried on the surface of the base plate 10. Specifically, the base plate 10 measures about 1330 mm long×about 700 mm wide. The base plate 10 is made as thin as possible. Specifically, the base plate 10 measures about 12 mm thick.

The rectangular frame section 30 of the palette body 1 comprises two spaced apart long side portions 310, 320 which are opposite to each other and extend in a longitudinal direction of the base plate 10, and two spaced short side portions 330, 340 which are opposite to each other and extend perpendicularly to the long side portions 310, 320 of the base plate 10. The palette body 1 further includes an intermediate rising section 350 which stands upwardly from the surface of the base plate 10, extend perpendicularly to the long side portions 310, 320, and divides the surface of the base plate 10 into two zones A, B. The driver's seat and the assistant driver's seat are adapted to be carried on the zones A and B (or B and A), respectively. The first long side portion 310 of the frame section 30 and the second long side portion 320 of the frame section 30 comprise a pair of spaced apart rising plates 310*a*, 310*b* opposite to each other, and a pair of spaced apart rising plates 320*a*, 320*b*, 310*b* opposite to each other. Also, the first short side portion 330 of the frame section 30 and the second short side portion 340 of the frame section 30 comprise a pair of spaced apart rising plates 330*a*, 330*b* opposite to each other, and a pair of spaced apart rising plates 340*a*, 340*b* opposite to each other. Similarly, the intermediate rising section 350 comprises a pair of spaced apart rising plates 350*a*, 350*b* opposite to each other. Each of the rising portions is thiner than the base plate 10. Specifically, each of the rising portions has a thickness of about 6 mm.

Figure 3:
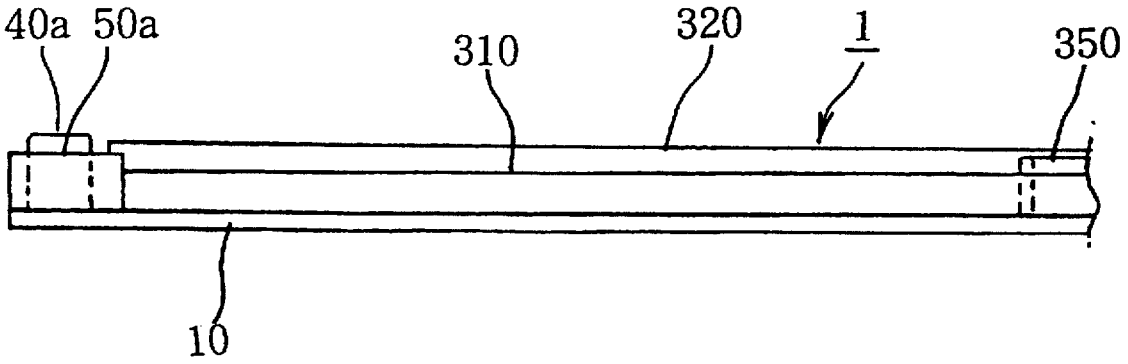
FIG. 3 is a schematic view showing a long side of a rectangular palette body of the palette.
Figure 4:
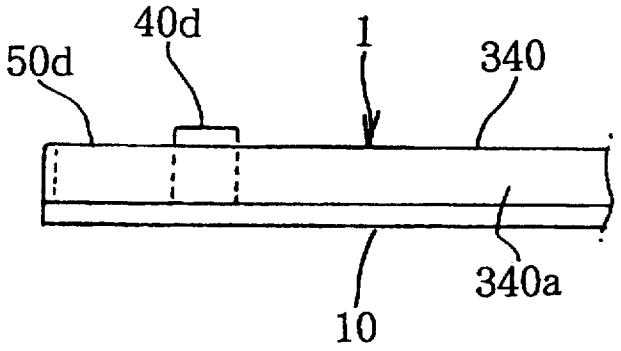
FIG. 4 is a schematic view showing a short side of the rectangular palette body.

Reference numerals 40*a*, 40*b*, 40*c*, 40*d* denote posts which are disposed in proximity to four corners of the base plate 10 and stand upwardly form the surface of the base plate 10. Each of the long side portions 310, 320 and short side portions 330, 340 of the frame section 30 is located between two adjacent posts. Palettes of the present invention in non-use are adapted to be vertically stacked. When they are vertically stacked, the posts 40*a*, 40*b*, 40*c*, 40*d* of each of the palettes serves as means to support a palette superposed on the palette. As shown in FIGS. 1, 3 and 4, the posts 40*a*, 40*b*, 40*c*, 40*d* stand upwardly higher than the long and short side portions 310, 320, 330, 340 of the frame section 30, and the intermediate rising section 350. The height of the palette which includes the rising height of the posts 40*a*, 40*b*, 40*c*, 40*d* and the thickness of the base plate 10 is set at about 60 mm, preferably about 58 mm.

Frame-like rib portions 50*a*, 50*b*, 50*c*, 50*d* for reinforcing the base plate 10 are disposed on and rise up from the surface of the corners of the base plate 10. Each of the rib portions 50*a*, 50*b*, 50*c*, 50*d* is formed into a substantially delta-shape in plane. Connecting rising plates 350*c* are located between and interconnect the spaced apart rising plates 350*a*, 350*b* of the intermediate rising portion 350, whereby the base plate 10 is also reinforced.

Figure 5:
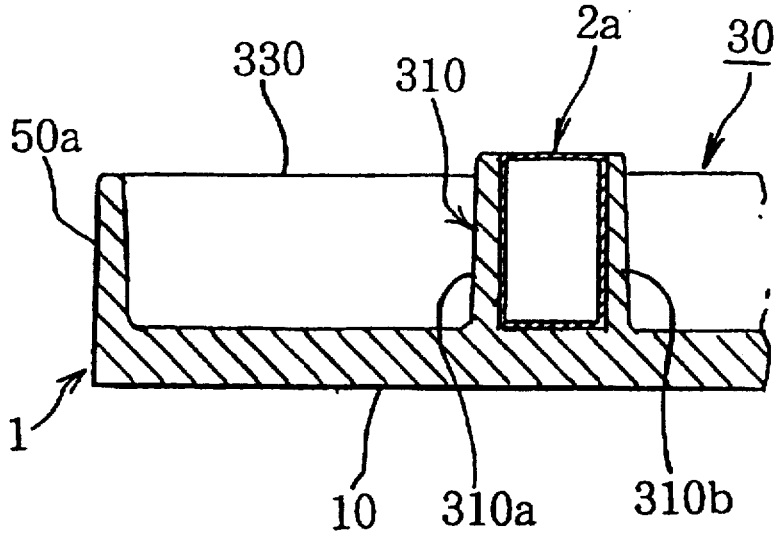
FIGS. 5 and 6 are each a schematic enlarged sectional view showing a square steel pipe assembled to the rectangular palette body.
Figure 6:
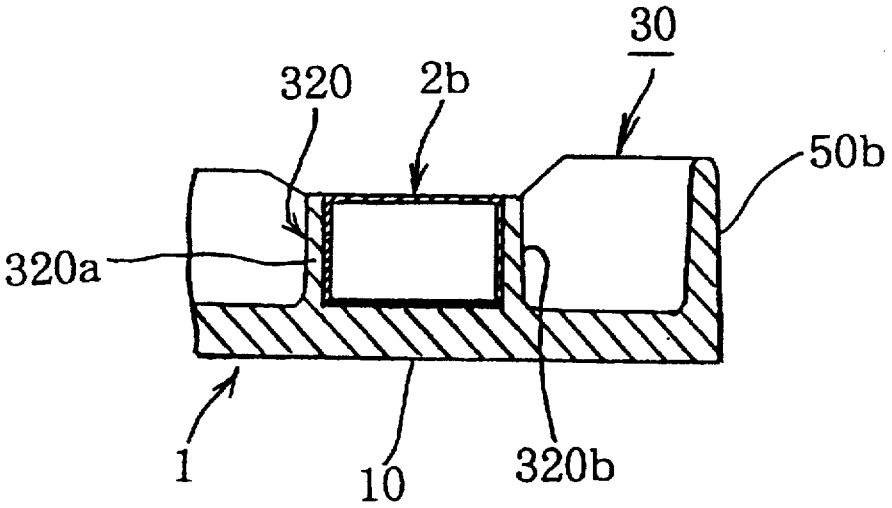

As shown in FIGS. 5 and 6, the square steel pipes 2*a*, 2*b* which are briefly described above are fitted in a space between the spaced apart rising plates 310*a*, 310*b* of the first long side portion 310 of the frame section 30, and a space between the spaced apart rising plates 320*a*, 320*b* of the second long side portion 320 of the frame section 30, whereby high strength is given to the palette according to the present invention. Each of the square steel pipes 2*a*, 2*b* has a length substantially equal to those of the long side portions 310, 320 of the frame section 30. In the illustrated embodiment, each of the square steel pipes 2*a*, 2*b* has a substantially rectangular shape in cross-section which is about 25 mm in width and about 40 mm in length. The thickness of a wall of each of the square steel pipes 2*a*, 2*b* is about 1.2 mm. Since the square steel pipes 2*a*, 2*b* are not too common for lightweight and give high strength to the palette body 1, they are highly desirable.

The square steel pipes 2*a*, 2*b* are assembled to the palette body 1 after the palette body 1 is formed by reaction injection molding. They may be integrated with the palette body 1 by insert molding simultaneously with the reaction injection molding of the palette body 1. However, a cooling temperature difference exists between the palette body 1 and the pipes 2*a*, 2*b*, so that when the pipes 2*a*, 2*b* are integrated with the palette body 1 by the insert molding and a combination of the palette body 1 and steel pipes 2*a*, 2*b* is cooled, there is a possibility that the palette body 1 will be bent backwards because of difference in coefficient of linear expansion between the palette body 1 and the steel pipes 2*a*, 2*b* due to the existence of the cooling temperature difference. When the palette body 1 is bent backwards, there is a possibility that the seats carried on the palette body 1 will drop from the palette body 1 during conveyance of the palette having the seats carried on the palette body 1 thereof. In addition to this, the palette body 1 will be cracked owing to internal stresses, resulting in the strength of the palette body 1 being siginificantly lowered. Therefore, as described above, the steel pipes 2*a*, 2*b* are fitted in the space between the rising plates 310*a*, 310*b* of the first long side rising portion 310 and the space between the rising plates 320*a*, 320*b* of the second long side rising portion 320, respectively, and are fastened to the palette body 1 by, e.g., bolts and nuts. Thus, it is possible to prevent the warping of the palette body 1.

The seats assembled in an assembly line are conveyed from the assembly line toward a place, where the seats are to be carried out, while being carried on the palette according to the present invention. At this time, the palette having the seats carried thereon is conveyed toward the place with the first long side portion 310 of the frame section 30 thereof facing to a conveying direction. Bearing on this, the first long side portion 310 of the frame section 30 has a rising height more than that of the second long side portion 320 as shown in FIGS. 5 and 6. The seats are carried on the zones A and B of the surface of the base plate 10 with front sides thereof being opposite to an inner surface of the first long side portion 310 of the frame section 30. Therefore, when the palette having the seats carried thereon is conveyed, the first long side portion 310 of the frame section 30 serves as a stopper to prevent the seats from being shifted.

The space between the rising plates 320*a*, 320*b* of the second long side portion 320 of the frame section 30 is relatively wider than that between the rising plates 310*a*, 310*b* of the first long side portion 310 of the frame section 30. This enables the seats to be stably supported even though a rear side (or rear sides) of the seat (or seats) is accidentally put on the rising plates 320*a*, 320*b* of the second long side portion 320 of the frame section 30.

Bearing on the above constructions, the first steel pipe 2*a* and the second steel pipe 2*b* are fitted in the space between the rising plates 310*a*, 310*b* of the first long side portion 310 of the frame section 30 and the space between the rising plates 320*a*, 320*b* of the second long side portion 320 of the frame section 30 in different postures as shown in FIGS. 5 and 6. More particularly, the first steel pipe 2*a* is fitted in the space between the plates 310*a*, 310*b* of the first long side portion 310 of the frame section 30 with long sides of the rectangular-shape in cross-section thereof standing upwardly. The second steel pipe 2*b* is fitted in the space between the plates 320*a*, 320*b* of the second long side portion 320 of the frame section 30 with long sides of the rectangular-shape in cross-section thereof being laid horizontally.

Figure 7:
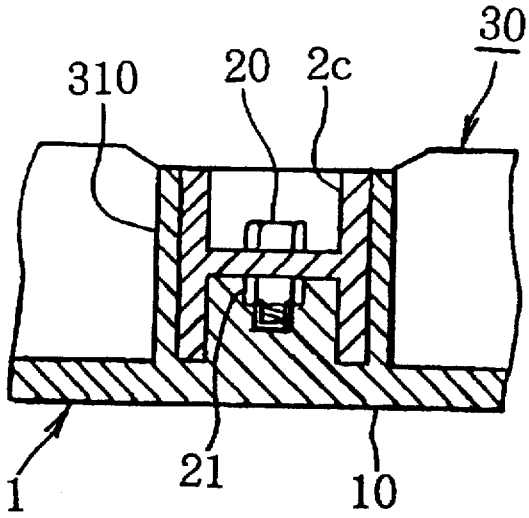
FIG. 7 is a schematic enlarged sectional view showing an H steel assembled to the rectangular palette body in lieu of the square steel pipe.
Figure 8:
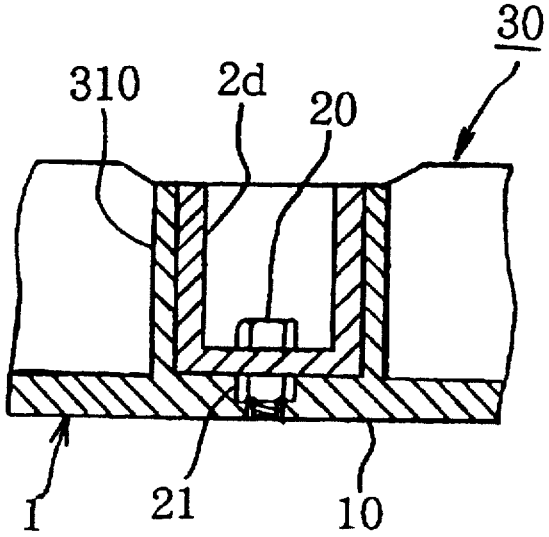
FIGS. 8–10 are each a schematic enlarged sectional view showing a U steel assembled to the rectangular palette body in lieu of the square steel pipe.
Figure 9:
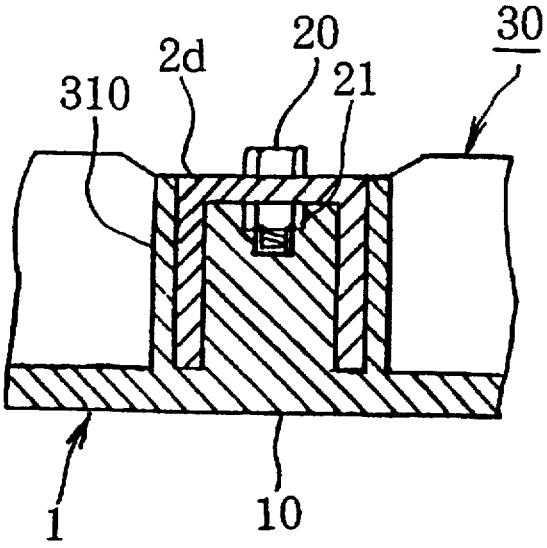
Figure 10:
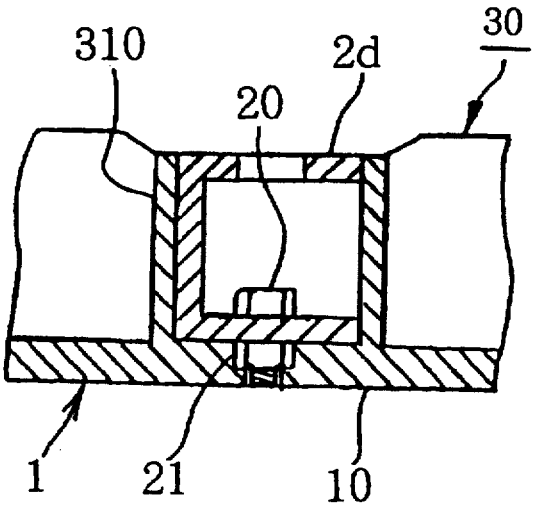

Referring to FIGS. 7–10, there are illustrated various shape steels which may be employed in lieu of the square steel pipes 2*a*, 2*b*. The shape steel 2*c* of FIG. 7 is an H section steel. The shape steels 2*d* of FIGS. 8–10 are U section steels. As shown in FIGS. 8–10, the U section steels 2*d* may be assembled to the palette body 1 in various postures. More particularly, the U section steel 2*d* of FIG. 8 is assembled to the palette body 1 with an opening side of the U section steel 2*d* facing upwardly. The U section steel 2*d* of FIG. 9 is assembled to the palette body 1 with an opening side of the U section steel 2*d* facing downwardly. The U section steel 2*d* of FIG. 10 is assembled to the palette body 1 with an opening side of the U section steel 2*d* facing laterally. In the event event that each of the shape steels 2*c*, 2*d* is to be fastened to the rising plates 310*a*, 310*b* (or the rising plates 320*a*, 320*b*) of the first long side portion 310 (or the second long side portion 320) of the frame section 30 by a bolt 20 and a nut 21, the nut 21 may be embedded in the palette body 1 when the palette body 1 is made by reaction injection molding. Even though the shape steel is fastened to the rising plates 310*a*, 310*b* of the first long side portion 310 of the frame section 30 by the bolt 20 and the nut 21 embedded in the palette body 1, any warping and deformation of the palette body 1 are not produced.

In order that the palette can be transferred by a folk lift truck, each of two long side portions of the rectangle-shaped base plate 10 may be formed with two notches 100, 101 with which folks of the folk lift truck are to be engaged when the palette is transferred by the folk lift truck. Rubber belts 110, 111 for preventing load shifting are coupled at ends thereof to one of the two long side portions of the rectangle-shaped base plate 10. Bearing on this, bolts 120, 121 or eyebolt 122 are attached to the rising plate 310*a* standing vertically from the other of the two long side portions of the rectangle-shaped base plate 10. By causing the other ends of the rubber belts 110, 111 to be caught by the bolts 120, 121 or eyebolt 122, the rubber belts 110, 111 span the palette body 1. Thus, the load shifting of the seats on the base plate 10 is prevented.

As discussed above, the palette body 1 is formed of resinous material which contains as the main component thereof dicyclopentadiene which is $C_5$ fraction of petroleum and physically contributes to the toughness, low-temperature impact strength and heat-resistance of the resinous material. Therefore, the palette according to the present invention has strength which resists the total weight of the seats which are to be carried on the base plate 10, resists frequent use of the palette and resists wear, heat-resistant strength, winterization-strength and solvent resistance. The palette according to the present invention is constructed by causing the square steel pipes to be assembled to the palette body 1 as discussed above, so that even though the palette body 1 is made thin in order to provide a thin and lightweight palette, the palette has deflection strength, stiffness and general strength including toughness provided by the resinous material of the palette body 1.

A sample of the palette of the present invention was made provided that the length of the rectangular base plate 10 is about 1330 mm, the width of the base plate 10 is about 700 mm, the thickness of the base plate 10 is about 12 mm, the rising height including the thickness of the base plate 10 and rising height of the posts 40*a*, 40*b*, 40*c*, 40*d* is about 58 mm, and square steel pipes each of which is about 40 mm long in cross-section, about 25 mm wide in cross-section and about 1.2 mm thick are employed. Under the above conditions, a lightweight palett which has a total weight of about 17 kg including the weight of the other components discussed above could be provided. The results of the physical properties testing are shown in the following Table.

TABLE

| Physical Properties | Required Specification | Results |
|---|---|---|
| Deflection limit | Initial deflection amount of base plate at the time that 120 kg seats are carried on the palette is 4.3 mm or less | Initial deflection amount of base plate is 2.7 mm (3.0 mm max.), OK |
| General strength | No crack under load of 49 Kgf · m × 1250 times | No crack, OK |
| Wear resistant | No crack at the time that the palette having 120 kg seats carried thereon is moved 45 m × 1250 times | No crack, OK |
| Strength of seats carring area of the palette | No crack under load of 1250 kg × 1250 times | No crack, OK |
| Heat-resistant strength | No deformation and crack under a temperature of 80° C. for 240 hours | No deformation and crack, OK |
| Winterization strength | No crack under a temperature −10° C. for 240 hours | No crack, OK |

It will thus be appreciated that since the palette body of the palette according to the present invention is formed of resinous material which contains as the main component thereof dicyclopentadiene which is $C_5$ fraction of petroleum and physically contributes to the toughness, low-temperature impact strength and heat-resistance, the palette of the present invention has strength which resists the total weight of seats which are to be carried on the base plate 10, resists frequent use of the palette and resists wear, heat-resistant strength, winterization-strength and solvent resistance. In addition, the palette according to the present invention is constructed by causing the lightweight square steel pipes to be assembled to the palette body, so that even though the palette body is made thin in order to provide a thin and lightweight palette, the palette has deflection strength, stiffness and general strength including the toughness provided by the resinous material of the palette body.

The terms and expressions which have been employed herein are used as terms of description and not of limitation. There is no intention in the use of such terms and expressions to exclude any equivalents of the features described or any portion thereof. It is recognized, however, that various modifications are possible within the scope of the invention claimed.

What is claimed is:

1. A pallet for carrying a driver's seat and an assistant driver's seat in a pair, or a seat for several passengers, comprising:

a substantially rectangle-shaped base plate having a surface on which said driver's seat and assistant driver's seat in a pair or said seat for several passengers is to be carried;

said base plate having two long sides and two short sides defining a perimeter;

a frame-like rising section of a substantially rectangle-shape rising from said base plate within the perimeter thereof;

a frame-like rising section comprising a pair of first spaced apart rising plates, a pair of second spaced apart rising plates, a pair of third spaced apart rising plates and a pair of fourth spaced apart rising plates;

said first and second pairs of spaced apart rising plates being provided on and extending in parallel relation to said two long sides of said base plate;

said third and fourth pairs of spaced apart rising plates being provided on and extending in parallel relation to said two short sides of said base plate;

said base plate and frame-like rising section being molded in one piece of resinous material using a reaction injection molding process;

said resinous material containing as the main component thereof dicyclopentadiene which is C5 fraction of petroleum, whereby said pallet has physical properties such as general strength, resistance to the total weight of said driver's seat and assistant driver's seat or said seat for several passengers, resistance to deflection, resistance to wear, refractory strength, low temperature strength, and solvent resistance, and can conform to the requirements for a thin-type pallet; and first and second reinforcing means for giving rigidity to said pallet;

said first reinforcing means and said second reinforcing means being fitted in a first space between said first pair of spaced apart rising plates and a second space between said second pair of spaced apart rising plates, respectively;

said first and second reinforcing means thereby extending longitudinally along said first and second pairs of spaced apart rising plates.

2. The pallet as defined in claim 1, wherein said first and second reinforcing means have been fitted into said first and second spaces after the reaction injection molding of said base plate and frame-like rising section.

3. The pallet as defined in claim 2, wherein said first and second reinforcing means are selected from the group consisting of square steel pipes, H-section steels and U-section steels.

4. The pallet as defined in claim 3, wherein said first spaced apart rising plates have a rising height more than that of said second spaced apart rising plates.

5. The pallet as defined in claim 4, wherein said first and second reinforcing means comprise steel pipes having substantially rectangular, transverse cross sections and the steel pipe of said first reinforcing means is oriented so as to have a higher cross-sectional profile than the steel pipe of said second reinforcing means.

6. The pallet as defined in claim 1, wherein said first and second reinforcing means are selected from the group consisting of square steel pipes, H-section steels and U-section steels.

7. The pallet as defined in claim 6, wherein said first pair of spaced apart rising plates have a rising height more than that of said second pair of spaced apart rising plates.

8. The pallet as defined in claim 7 wherein said first and second reinforcing means comprise steel pipes having substantially rectangular, transverse cross sections and the steel pipe of said first reinforcing means is oriented so as to have a higher cross-sectional profile than the steel pipe of said second reinforcing means.

* * * * *